US005313219A

United States Patent [19]

Shakun et al.

[11] Patent Number: 5,313,219

[45] Date of Patent: May 17, 1994

[54] SHIPBOARD STABILIZED RADIO ANTENNA MOUNT SYSTEM

[75] Inventors: Wallace Shakun, Atlanta; Richard A. Levy, East Point, both of Ga.

[73] Assignee: International Tele-Marine Company, Inc., Miami, Fla.

[21] Appl. No.: 847,313

[22] Filed: Mar. 6, 1992

Related U.S. Application Data

[63] Continuation-in-part of Ser. No. 826,017, Jan. 27, 1992.

[51] Int. Cl.[5] ..... H01Q 3/08

[52] U.S. Cl. ..... 343/765; 343/709

[58] Field of Search ..... 343/765, 766, 709, 878, 343/879, 882; 248/125, 183

[56] References Cited

U.S. PATENT DOCUMENTS

| | | | |
|---|---|---|---|
| 3,860,931 | 1/1975 | Pope et al. | 343/709 |
| 3,968,496 | 7/1976 | Brunvoll | 343/765 |
| 3,999,184 | 12/1976 | Fuss, III | 343/765 |
| 4,020,491 | 4/1977 | Beiser et al. | 343/765 |
| 4,433,337 | 2/1984 | Smith et al. | 343/765 |
| 4,467,726 | 8/1984 | Aldous et al. | 343/882 |
| 4,596,989 | 6/1986 | Smith et al. | 343/765 |
| 4,621,266 | 11/1986 | Le Gall et al. | 342/359 |
| 4,803,490 | 2/1989 | Kruger | 342/158 |
| 4,833,932 | 5/1989 | Rogers | 74/343 |
| 4,920,349 | 4/1990 | Le Gall | 343/709 |

*Primary Examiner*—Donald Hajec
*Assistant Examiner*—Tan Ho
*Attorney, Agent, or Firm*—Troutman, Sanders

[57] ABSTRACT

A stabilized antenna mount system is described which includes an antenna subassembly, a means for allowing the subassembly to rotate in three dimensional planes, and a means for stabilizing the subassembly. The subassembly rotates by means of a multi-axis bearing and is stabilized with an inertia mass attached to its lower portion. The inertia mass has a weight approximately six times the combined weight of the subassembly and the multi-axis bearing. Optionally, to counter the effects of the wind, a set of fins, with or without an aerodynamic upper housing, or a protective shield may be attached.

34 Claims, 10 Drawing Sheets

SHIPBOARD STABILIZED RADIO ANTENNA MOUNT SYSTEM

CROSS-REFERENCE TO RELATED APPLICATION

This application is a Continuation-In-Part of Ser. No. 826,017 filed Jan. 27, 1992.

BACKGROUND OF THE INVENTION

This invention relates to a stabilized mount system for radio antennas. More specifically, this invention relates to a purely mechanical stabilization system for mounting radio antennas, such as those used in cellular telephone systems on vehicles such as ships.

Typically, vehicles such as ocean going ships are subjected to motion, such as roll, pitch and yaw, caused, for example, by result of wave motion, gusting winds, and the acceleration, deceleration and turning of the vehicle. Often, a ship may be subject to pitch and roll movements in the order of ±20°, depending on the size of the ship and the loading conditions. Many ocean vessels come equipped with stabilizers to assure that the movement does not exceed ±20°.

In conventional antenna systems (see FIGS. 17 through 20), uniform signals are transmitted from a single source point, with gain and beam width being varied to adapt to the application. An ocean vessel antenna system requires high gain to minimize power requirements. Referring to FIG. 18 and FIG. 19 it may be seen that as an antenna's gain increases, the beam width narrows and the allowable limits on the physical orientation of the antenna decrease. Further, as shown in FIG. 20, without a stabilization system, the combination of a narrowed beam width and the roll, pitch, and yaw of a ship can cause a radiated signal from the antenna to intersect the surface of the water or to otherwise reach an undesirable cell site location. Therefore, an effective antenna stabilization system must compensate for the roll, pitch and yaw of the ship, and also act to decouple the transmission and reception characteristics of the antenna from the movements of the ship.

Many conventional antenna stabilization systems are electronically controlled and/or electrically driven. These systems often include gyroscopes, servomotors, microprocessors, and various forms of feedback circuits. Commonly, stabilization devices use gyros in combination with multi-access integrators, in order to stabilize a platform system. The passive stabilization system is further controlled by a feedback loop, which interacts with motors to assure that the system is continuously stable by moving the gyro and pendulum weight as needed. Other devices make similar use of the electronic controls, but use a pendulum connected to a spring or a ring mounted for rotation on a radome. These systems also make use of a feedback loop and motors to stabilize the system.

U.S. Pat. No. 3,968,496 to Brunvoll describes a purely mechanical stabilization system which incorporates a counterweight supported in a universal joint bearing. The system includes an elevational and azimuth controller mounted to a platform with a shaft, which is supported by the universal joint bearing. This system makes use of a small mass system, which incorporates a container enclosing two curved tubes which may be filled with liquid and/or small balls. The mass system is mechanically coupled to the platform shaft and is used to stabilize and/or damp the movements of the antenna caused by a ship. The Brunvoll invention includes a servo motor and a momentum wheel driven by a motor as possible accessories to improve the stabilization of the system. Due to the construction of this invention, it is believed to be expensive to produce and subject to high maintenance.

Systems using gyros and/or electronic feedback loops are often quite expensive to manufacture and incur high field service and maintenance costs. A passive mechanical system could significantly reduce costs if adequate stabilization means could be obtained. Previously, designers of mechanical systems have had difficulties designing a system which provides adequate damping to reduce the possibility of oscillation, while at the same time providing adequate decoupling of the antenna from the ship's motion so as to meet the accuracy needs of the radio transmission system.

SUMMARY OF THE INVENTION

Accordingly, it is an object of this invention to provide a fully mechanical antenna stabilization system for modes of transportation that has no need for a gyroscope or for electronic peripheral equipment.

It is yet another object of this invention to provide a fully mechanical antenna stabilization system which has an assembly that is fully self contained on one platform.

It is still another object of this invention to provide a fully mechanical antenna stabilization system which has one moving multi-axis stabilization component.

It is another object of this invention to provide a fully mechanical antenna stabilization system for vehicles that incorporates one mechanical attachment as a means of securing the system to the vehicle's structure.

It is still a further object of this invention to provide a fully mechanical antenna stabilization system for more than one antenna.

These and other objects are achieved by the antenna stabilization system of the present invention. In a preferred embodiment, the system includes six main components: a lower and upper subassembly housing, a multi-axis bearing, a structural support system, such as a fixture, an inertia mass, and, optionally, a wind effect reducer, such as a set of fins. The multi-axis bearing may be connected to the subassembly housings by a suitable means, such as a double-sided stud; the structural support fixture is secured to the multi-axis bearing shaft by suitable means, such as a nut; and the inertia mass may be attached to the antenna housing with a strong adhesive, such as an epoxy. The wind-effect equalizing fins may be attached below the multi-axis bearing by suitable means, such as a pin or epoxy.

The presently preferred version of the subassembly housing includes three main components: a fiberglass interior housing, an exterior housing, and a ferrule. The antenna is encapsulated in the interior housing and the ferrule is mounted to the top of this housing. A transceiver cable attached to the antenna protrudes through a hole in the ferrule. This hole is insulated around the cable to assure that the antenna is adequately protected from the elements. Both the interior housing and the ferrule are surrounded by the cylindrical exterior housing, which preferably is formed of a hard plastic material. The exterior housing has a cable spline cutout, which allows the transceiver cable to be connected directly to the antenna through the ferrule.

Optionally, a plurality of slip rings, with the transceiver cable running through them, may be mounted to the outside of the exterior housing to allow the assembly to rotate freely. The slip rings are used to prevent the cables from getting tangled about the housing and to eliminate the rotational drag that could occur if the cables wrapped around the antenna housing.

The ferrule and the lower subassembly housing's exterior housing have at least one locking pin hole which are aligned to allow for a locking pin to be inserted. The locking pin acts as a safety mechanism to assure that the system will remain securely in place by locking the ferrule and the exterior housing together. Further, it provides a means for the weight of the system to be transferred away from the fiberglass interior housing to the ferrule and the exterior housing.

The multi-axis bearing has a socket, with a hole through its center, on one of its ends and a threaded shaft on the other end. The socket contains a spherical structure, such as a metal ball, that has its top and bottom cut off, and has a hole through its center. A double-sided stud passing through the hole in the socket and the spherical object may be used to attach the multi-axis bearing to the interior threading in the head of the ferrules in both the lower and upper subassembly housings. For this embodiment, the upper subassembly housing is attached to the multi-axis bearing upside down.

The structural support system may take two forms: a structural support fixture or a structural support platform. In a preferred embodiment, the structural support fixture is used. It is crimped at right angles and has one hole through a center portion to accommodate the multi-axis bearing shaft. It also has at least one hole in its top end and at least one hole in its bottom end, which allows the structural support fixture to be secured to a vertical surface of a structure. The threaded shaft on the multi-axis bearing allows the structural support fixture to be slid on to it and secured into place by suitable means, such as a nut. A set screw in the side of the nut my be used to level the system.

The inertia mass is preferably made of metal and is encapsulated in a protective plastic housing. It has one hole in its top, which allows the antenna housing to be inserted into place and secured within it.

When the system is completely assembled and mounted, the lower subassembly housing hangs from the multi-axis bearing. As the vehicle rolls, pitches, or yaws, the freedom of movement of the ball in the socket of the multi-axis bearing allows the lower and upper subassembly housings to rotate in any direction to compensate for the changes in angles caused by the various movements of the vessel. It has been found that a 6:1 ratio between the weight of the inertia mass to weight of the other components of the system which are connected to the ball is particularly advantageous to assure that the antenna rotates in an accurate and stable manner.

The wind effect reducer may take two main forms: a set of fins attached to an appropriate location on the outer housing or a protective shield, which substantially prevents wind from stretching the outer housing or selected portions of it. In a preferred embodiment, an exterior housing with a circular cross-section is employed for the lower and upper subassembly and a set of fins is attached to the lower subassembly housing. The following equation, has been found to be most advantageous in determining the total effective projected surface area of the fins, where the antenna assembly is the combination of the lower subassembly coupled with the upper subassembly.

$$S_{PROJF} = \frac{C_{DA} \times S_{PROJA} \times l_A}{C_{DF} \times l_F}$$

where:

$S_{PROJF}$ = Projected Effective Surface Area of the Fins $C_{DA}$ = Drag of an Antenna Assembly (usually 0.5 or 0.6)

$S_{PROJA}$ = Projected Surface Area of the Antenna Assembly (Diameter of Assembly × Height of the Assembly)

$l_A$ = Length from the Multi-Axis Bearing to the Antenna Assembly Center of Pressure $C_{DF}$ = Drag of the Fins (usually 1.0 for a flat plate)

$l_F$ = Length from the Multi-Axis Bearing to the Center of Pressure of the Fin Area The effective projected surface area of the fins is important to assure that the fins provide sufficient restoring torque to counter the effects of the wind velocity pushing against the top portion of the subassembly housing. Since the multi-axis bearing allows the antenna mount system to rotate freely, the proper effective projected surface area also assures that the fins are urged to remain in a position perpendicular to the direction of the wind. For a ship moving at a maximum speed of 30 knots, a projected surface area of approximately 230 square inches is believed to be adequate for use with the antenna mountings described below.

Proper placement of the fins on the lower subassembly housing is crucial. In order to have the proper moment, the vertical midpoints of the fins should be positioned in the exterior of the lower subassembly housing between the multi-axis bearing and the inertia mass. Though approximately one-third the distance below the multi-axis bearing seems to be the optimum position for the set of fins, their positioning may be adjusted to account for varying conditions. If the set of fins are positioned too close to the multi-axis bearing, then the system will lose some of the torque created at the multi-axis bearing. Moreover, if the set of fins are positioned to close to the inertia mass, then interference from the ship may hamper the proper airflow from reaching the fins.

In other embodiments, the lower or upper subassembly housings may be assembled without an antenna encapsulated within them (see FIGS. 3–6). If the lower or the upper subassembly housing does not have an antenna contained in it, then the effective fin's surface area remains unchanged. However, the effective fin may be attached to the exterior housing of the upper subassembly housing between the multi-axis bearing and the top of the upper subassembly housing (see FIGS. 5 and 6). In this embodiment, the optimum position for the set of fins seems to be approximately one-third the distance above the multi-axis bearing, but the positioning of the fins may be adjusted to account for 10 varying conditions.

In another embodiment, the exterior housing of the upper subassembly housing may have an aerodynamic air foil added to the conventional circular exterior housing (see FIGS. 9–11). In this embodiment, the antenna configurations as described above for the conventional exterior housing remain unchanged. However, the projected surface area of the effective fin for the aerodynamic exterior housing should be approximately 25% less than the projected surface area of the effective fin for the conventional circular exterior housing.

In yet another embodiment, a conically shaped protective shield, also known as a shroud, may be used to prevent the system from being affected by the effects of the wind by covering the upper subassembly housing (see FIGS. 14–16). The shield is attached to the top of the multi-axis bearing with suitable means, such as a plurality of evenly spaced bolts, and extends to the top of the upper subassembly housing. It is constructed with an interior large enough to allow the subassembly to pivot in any direction at an angle of up to 20° from its center to allow for the ship's pitch, roll and yaw. The shield also has a plurality of holes in it to alleviate pressure and to allow water drainage. For this embodiment, the use of fins is not necessary, and the antenna configurations as described above for the conventional exterior housing may still be used.

In a further embodiment, the upper subassembly housing may be removed from the antenna stabilization system (see FIG. 7). For this embodiment, a bolt, rather than the double-sided stud, is passed through the hole in the socket and the spherical object to attach the multi-axis bearing to the head of the ferrule in the lower subassembly housing. This configuration also uses the 6:1 inertia mass ratio to stabilize the system in the same manner as described above.

In another embodiment, the structural support platform is a self-sustaining platform. It has a horizontal top surface and a horizontal bottom structure, which are connected by a plurality of supports. The open area created by the spacing of the supports allows the lower subassembly housing to rotate and pivot freely. The outside wall of the multi-axis bearing, also known as the flange, is inserted into a center hole in the top surface and is secured by bolts or tack welds. The structural support platform may be secured to any horizontal surface of a structure by bolting and/or tack welding the bottom structure to the corresponding horizontal surface of a structure.

BRIEF DESCRIPTION OF THE DRAWINGS

The accompanying drawings illustrate a preferred embodiment of the invention, and serve to aid in the explanation of the principles of the invention.

DETAILED DESCRIPTION OF THE PREFERRED EMBODIMENT

Figure 1:
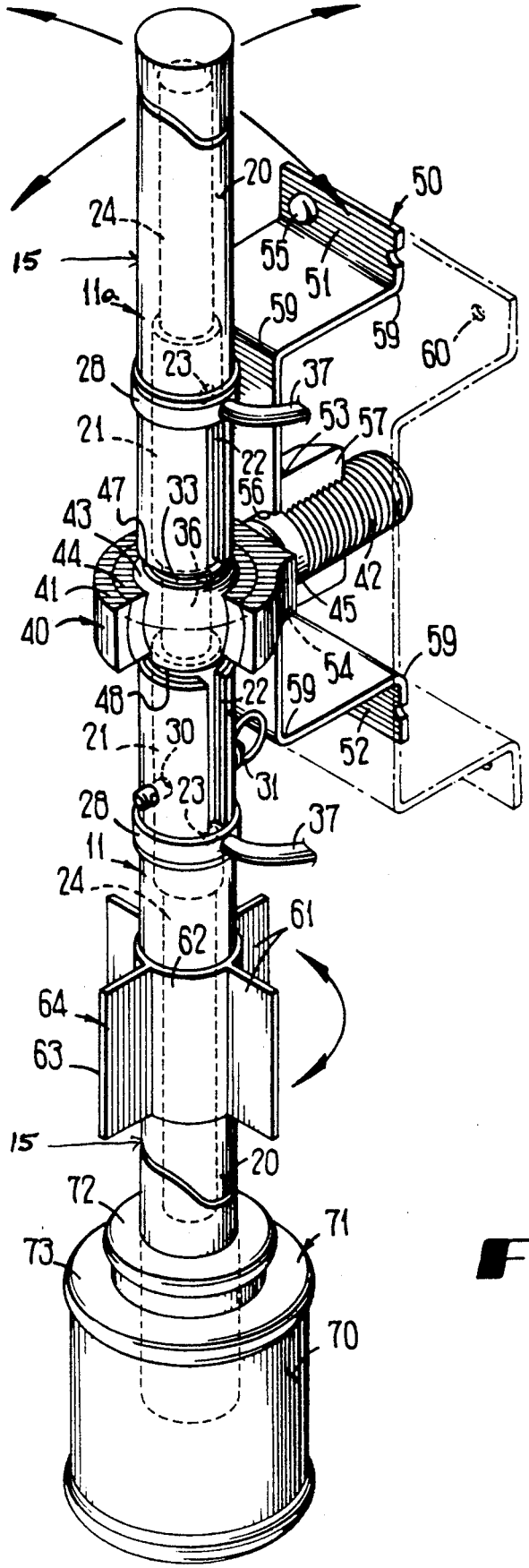
FIG. 1 is a cut away perspective of the dual stabilized mount system with a structural support fixture.
Figure 2:
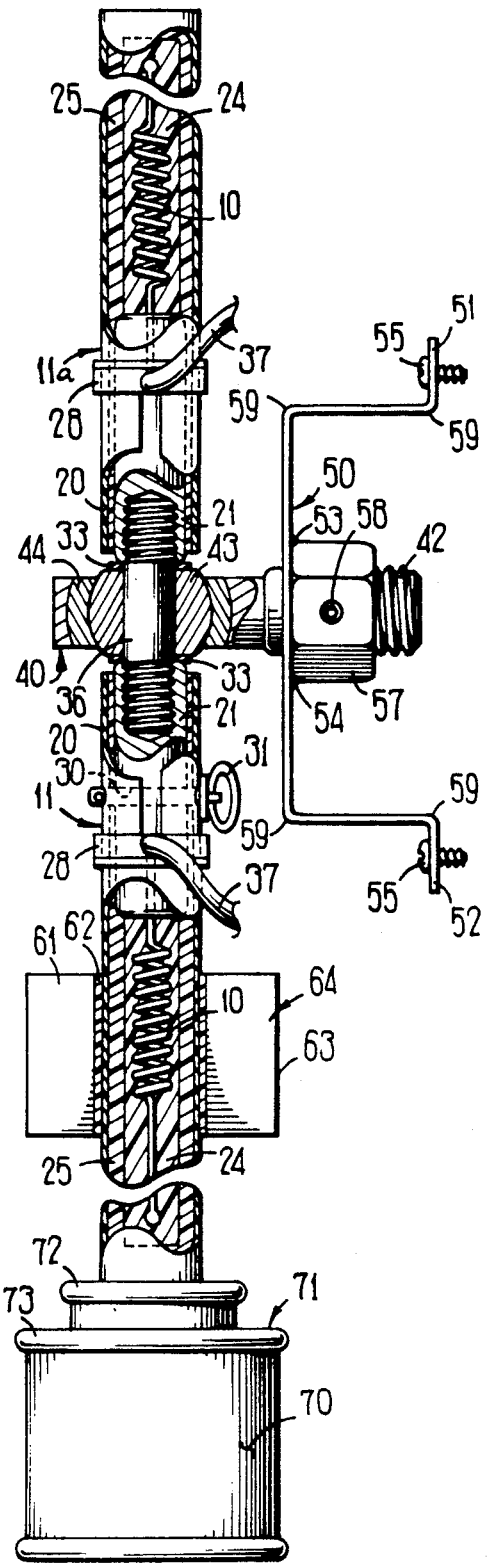
FIG. 2 is a cross-sectional view of the dual stabilized mount system with an upper and a lower antenna, a lower fin, and a structural support fixture.

As shown in FIGS. 1 and 2, a preferred but nevertheless illustrative embodiment of the stabilized mount system the present invention includes six main components: a lower subassembly housing 11, an upper subassembly housing 11, a multi-axis bearing 40, a structural support fixture 50, an inertia mass 71, and a set of fins 64.

The lower and upper subassembly housings 11 and 11*a* respectively, making up the antenna assembly 15 include three main components, an interior housing 24, an exterior housing 20 and a ferrule 21. As best shown in FIG. 2, the interior housing 24 encapsulates an antenna 10, and is preferably made of UV stabilized fiberglass. The ferrule 21 is attached to the top of the interior housing 24. The ferrule 21 is preferably molded of brass and covered with chrome. Both the interior housing 24 and the ferrule 21 are encompassed by the exterior housing 20. The exterior housing 20 is preferably formed of a high density non-corrosive, hard plastic, such as PVC tubing to provide protection from the elements such as salt spray. Prior to inserting the interior housing 24 and the ferrule 21 into the exterior housing 20, the exterior housing 20 is filled with a radio wave transparent silicon material, such as RTV silicon supplied by the General Electric Company, which is inserted in a gel form and allowed to harden to form a water tight bond along the ferrule and adjacent areas.

The exterior housing 20 has a cable spline cutout 22 in its side, and the ferrule 21 has a corresponding hole 23 in its side. When properly aligned, the cable spline cutout 22 and the hole 23 allow insertion of a transceiver cable 37 for attaching the antenna 10 to a remote transceiver (not shown). The transceiver cable 37 is a conventional radio frequency low loss electronic cable, which is insulated to meet marine specification standards. The hole 23 in the ferrule 21 is preferably insulated with silicon to prevent elements from the weather from penetrating to the antenna 10.

The slip rings 28 are mounted to the outside of the exterior housing 20. When the transceiver cable 37 is inserted into the slip rings 28, the subassembly housing is able to rotate freely. The slip rings 28, such as Precision Specialties' model series SRH or Fabricast's model number 1500, are preferably made of coin silver with silver graphite brushes and have a minimum of six contacts.

The exterior housing 20 has a hole on each side (not shown) and the ferrule 21 has a locking pin hole 30. When properly aligned, a locking pin 31, known as a dual ball safety pin, may be inserted in one side of the exterior housing 20, through the ferrule 21, and out the other side of the exterior housing 20. The locking pin 31 preferably has a push pin with balls on the end, which allows for easy insertion and secure locking. As best shown in FIG. 2, the silicon material 25, which partially fills the exterior housing 20, acts as the primary bond for the locking pin 31. Locking the ferrule 21 and the exterior housing 20 together with the locking pin 31 provides added safety to assure the structural integrity of the assembly. The locking pin 31 also provides a means for transferring the weight of the stabilized mount system away from the fiberglass interior housing 24 to the ferrule 21 and to the hard plastic exterior housing 20.

The multi-axis bearing body 40 includes a socket 44 and a ball 43, inserted into the socket 44 at the head 41 of the multi-axis bearing body 40, and a threaded shaft 42 connected at its neck 45. The multi-axis bearing body 40, such as Aurora's Rod End Bearing, is preferably made of cadmium plated metal. The area that the ball 43 rolls on is made of a self-lubricating teflon. The socket 44 and the ball 43 each have holes through their center and are preferably formed of metal such as stainless steel. The ball 43 has its top surface 47 and bottom surface 48 cut off so that both surfaces are flat and smooth.

The structural support fixture 50 is made up of one piece of metal, preferably 301 half-hard stainless steel. In the preferred embodiment, the support fixture 50 has four crimped right angles 59, but it can be crimped into other configurations to meet the requirements of the surface in which it is to be attached. The top 51 and the bottom 52 of the structural support fixture 50 each have three holes 60, for bolts 55, which allow the structural support fixture 50 to be mounted to a vertical surface of a structure. The center of the structure support fixture 50 has a hole 56, which has the circumference of the multi-axis bearing's threaded shaft 42, and has a nut 57 welded to it with an upper weld 53 and a lower weld 54.

The inertia mass 71 includes a combined upper mass 72 and lower mass 73. Both masses are preferably made of lead and are bonded to reduction/expansion fittings (not shown), which are safety wired with stainless steel wire (not shown). In a top portion of the inertia mass 71 there is a hole (not shown), which has the circumference of the exterior housing 20. An inertia mass housing 70 encompasses the inertia mass 71 and acts as a protective covering. It is preferably made of high density plastic, such as UV tolerant PVC, and is molded to the inertia mass 71. In a preferred embodiment, the weight of the inertia mass 71 is approximately six times the weight of the antenna assembly 15.

In a preferred embodiment, the wind effect reducer is a set of fins 64, which includes four equally spaced single fins 61. The single fins 61 are attached to a cylinder 62, which make up a fin tube assembly 63. The single fins 61 and the cylinder 62 are preferably made of anodized aluminum or fiberglass. This configuration is believed to provide the optimum effective drag.

To assure that the set of fins 64 remains in a position perpendicular to the direction of the wind, their effective projected surface may be approximated by the following equation.

$$S_{PROJF} = \frac{C_{DA} \times S_{PROJA} \times l_A}{C_{DF} \times l_F}$$

The lower subassembly housing 11, the upper subassembly housing 11*a*, and the multi-axis bearing 40 are connected with a double-sided stud 36. As best shown in FIG. 2, the upper subassembly housing 11*a* is mounted upside down and rests on one nylon bushing 33, which rests on the top surface of the multi-axis bearing ball 47 (see FIG. 1). The bottom surface of the multi-axis bearing ball 48 (see FIG. 1) rests on one nylon bushing 33, which rests on top of the ferrule 21 of the lower subassembly housing 11. The double-sided stud 36 is inserted through the ball 43, socket 44, and the upper and lower nylon bushings 33, and into the upper and lower subassembly housings 11*a* and 11. The double-sided stud 36 is secured to the subassembly housings 11*a* and 11 by screwing it into the top of the interiorly threaded ferrule 21 in each subassembly housing 11 and 11*a*. With the multi-axis bearing body 40 secured to the subassembly housings 11 and 11*a*, the rotating ball 43 is able to compensate for the pitch, roll and yaw of the water vessel.

The structural support fixture 50 is attached to the multi-axis bearing shaft 42. The multi-axis bearing shaft 42 is slid through the center hole 56 of the structural support fixture 50 and secured in place with a nut 57, which is screwed onto the threaded shaft 42. An allen set screw 58 is screwed into the side of the nut 57, and is used to level the stabilized mount system.

The inertia mass 71 is attached to the subassembly lower housing 11 by inserting it into the hole in the top of the inertia mass 71. The lower subassembly housing 11 is then secured into place with epoxy glue.

Figure 16:
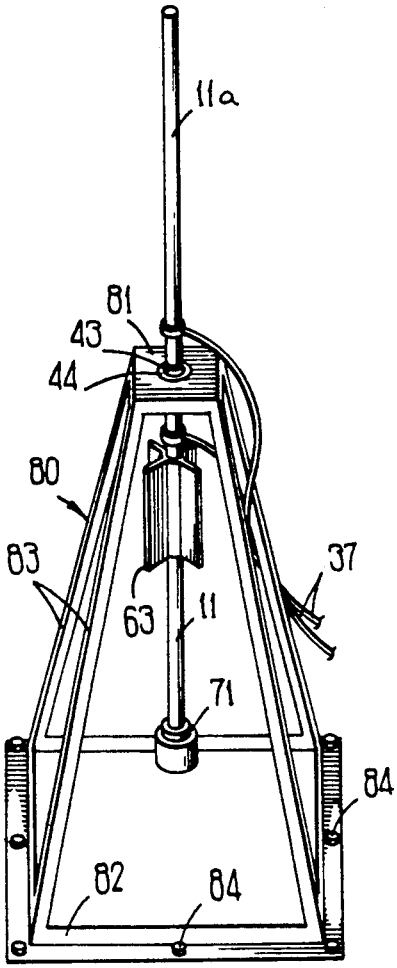
FIG. 16 is a three-dimensional exterior view of the dual stabilized mount system with a lower fin and a structural support platform.
Figure 18:
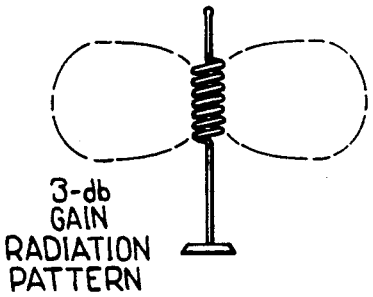
PRIOR ART FIG 18
FIGS. 18 and 19 are illustrations of the field patterns of antenna signals with varying gain emanating from antennas fixedly mounted.
Figure 19:
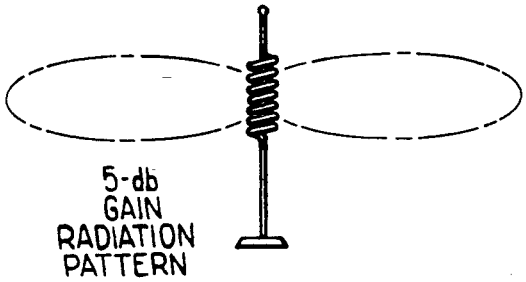
PRIOR ART FIG 19
Figure 17:
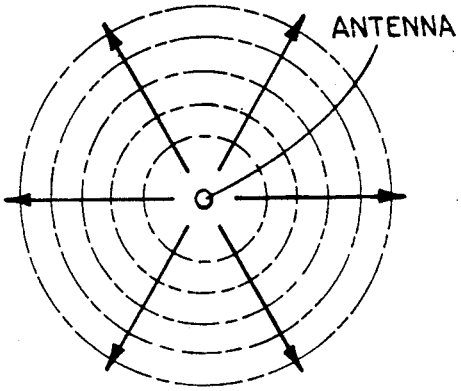
PRIOR ART FIG 17
FIG. 17 is an illustration of the field pattern of a uniform antenna signal emanating from a single source point.
Figure 20:
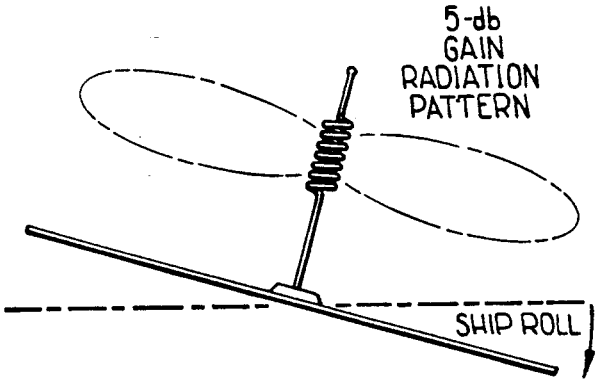
PRIOR ART FIG 20
FIG. 20 is an illustration of an unstable field pattern of a signal emanating from a fixedly mounted antenna.

The fin tube assembly 63 is slid over the exterior housing 20 of the lower subassembly housing 11 and epoxied or pinned into place. The single fins 61 may also be epoxied or pinned directly to the exterior housing 20, without use of the cylinder 62. As shown in FIG. 16, the fin tube assembly 63 is secured to the lower subassembly housing 11 between the multi-axis bearing 40 and the inertia mass 71. Currently, the optimum position for the fins tube assembly 63 seems to be approximately one-third the distance below the multi-axis bearing 40. However, positioning of the fin tube assembly 63 may be adjusted to account for varying conditions. If the single fins 61 are epoxied or pinned without use of the cylinder 62, then the single fins 61 will have approximately the same position as the fin tube assembly 63.

Figure 3:
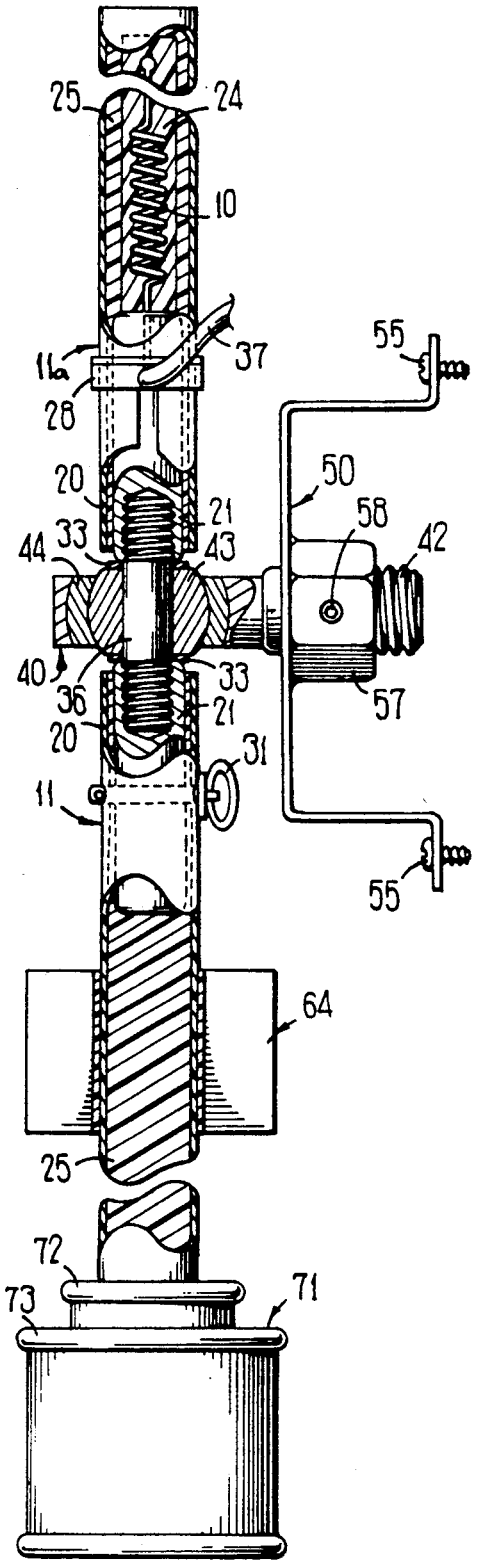
FIG. 3 is a cross-sectional view of the dual stabilized mount system with an upper antenna, a lower fin, and a structural support fixture.
Figure 4:
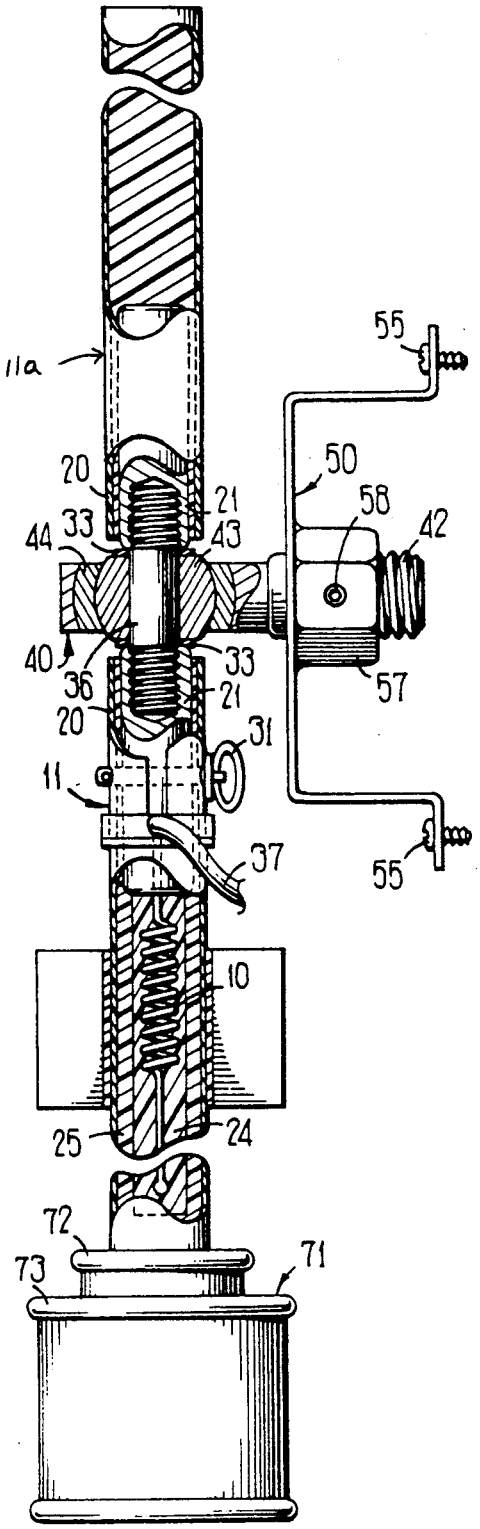
FIG. 4 is a cross-sectional view of the dual stabilized mount system with a lower antenna, a lower fin, and a structural support fixture.

In other embodiments, as shown in FIGS. 3 and 4, a single antenna device may be assembled. In these embodiments, the lower subassembly housing 11 may be assembled without an antenna 10 encapsulated within it (see FIG. 3), or the upper subassembly housing 11*a* may be assembled without an antenna 10 encapsulated within it (see FIG. 4).

Figure 6:
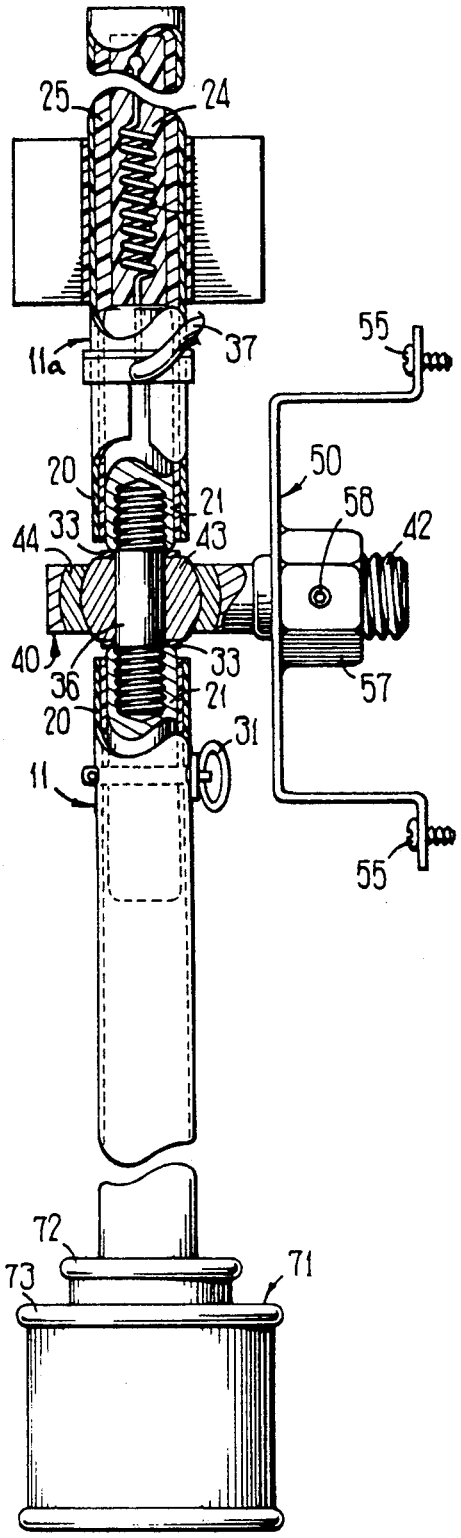
FIG. 6 is a cross-sectional view of the dual stabilized mount system with an upper antenna, an upper fin, and a structural support fixture.
Figure 5:
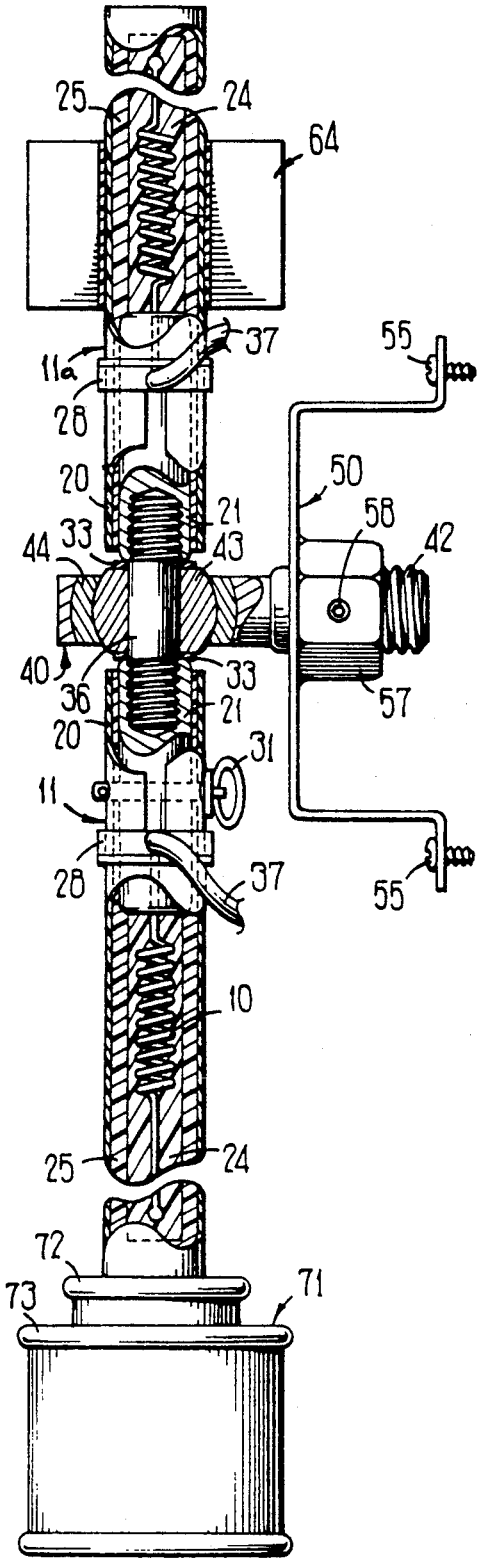
FIG. 5 is a cross-sectional view of the dual stabilized mount system with an upper and a lower antenna, an upper fin, and a structural support fixture.

In another embodiment, as best shown in FIGS. 5 and 6, the fin tube assembly 63 may be secured to the upper subassembly housing 11*a* between the multi-axis bearing 40 and the top of the upper subassembly bearing 11*a*. Currently, the optimum position for the fin tube assembly 63 seems to be approximately one-third the distance above the multi-axis bearing 40. However, the positioning of the fin tube assembly 63 may be adjusted to account for varying conditions. If the single fins 61 are epoxied or pinned without use of the cylinder 62, then the single fins 61 will have approximately the same position as the fin tube assembly 63.

In other embodiments, the set of fins 64 attached to the upper subassembly housing 11*a* may be used in conjunction with a single antenna 10. As shown in FIG. 6, the lower subassembly housing 11 may be assembled without an antenna 10 encapsulated within it, or (not shown) the upper subassembly housing 11*a* may be assembled without an antenna 10 encapsulated within it.

Figure 8:
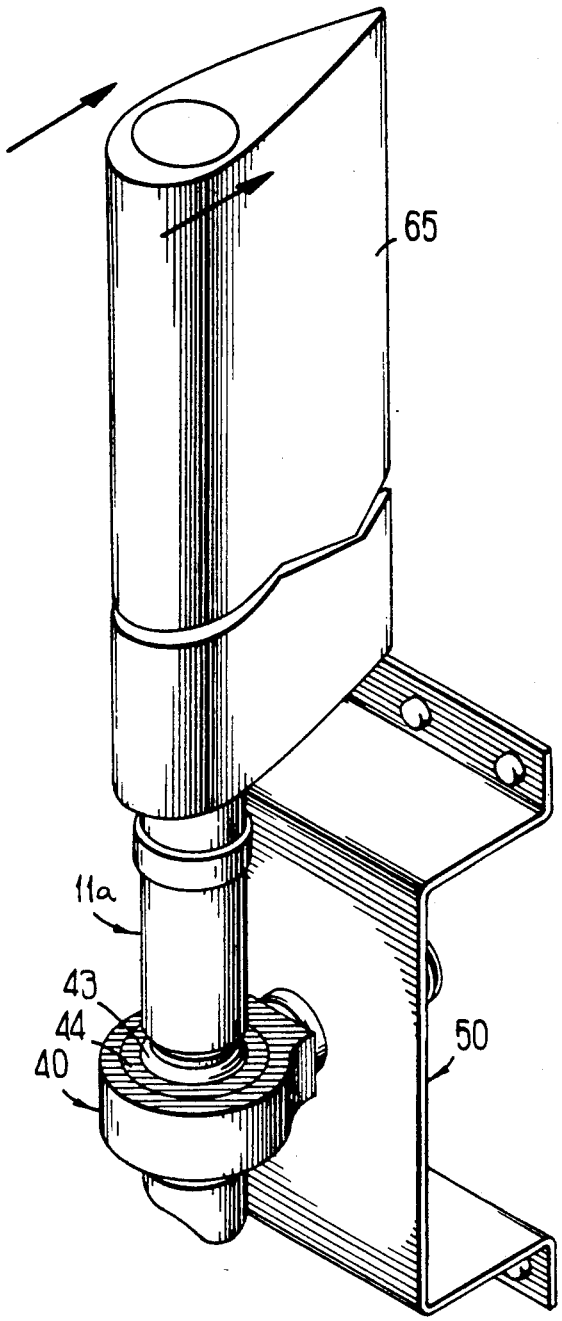
FIG. 8 is a three-dimensional exterior perspective of the aerodynamic air foil attached to the dual stabilized mount system.
Figure 10:
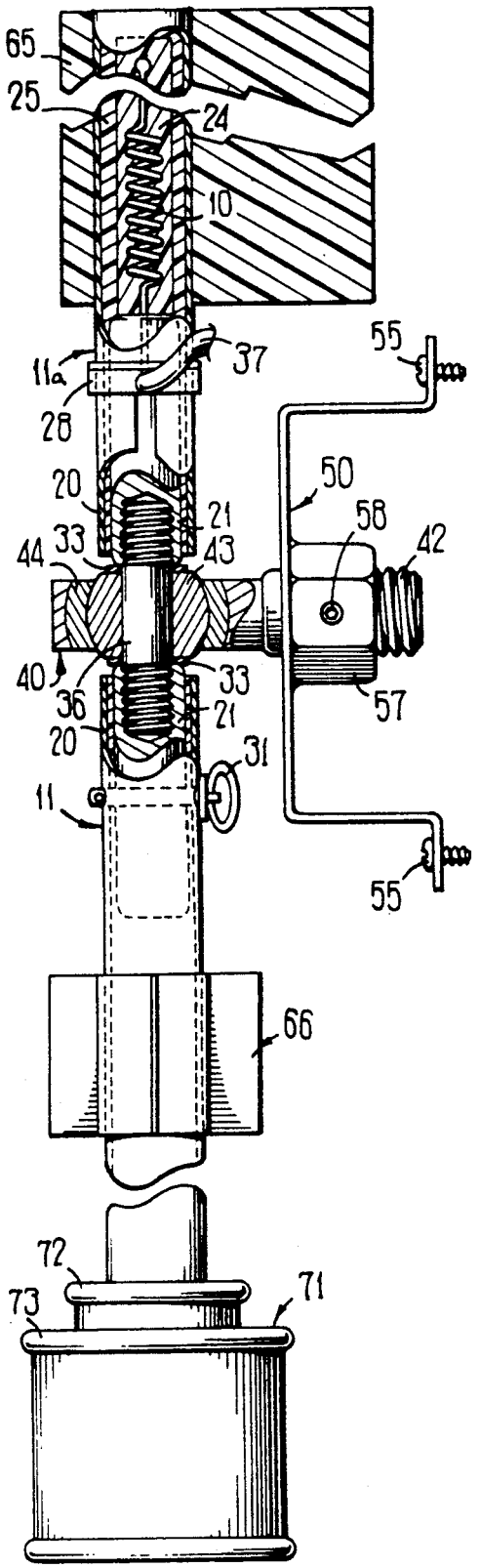
FIG. 10 is a cross-sectional view of the dual stabilized mount system with an aerodynamic air foil, an upper antenna, a lower fin, and a structural support fixture.

In yet another embodiment, as best shown in FIGS. 8–11, the set of smaller fins 66 may be attached to the lower subassembly housing 11 in conjunction with the aerodynamic air foil 65. As shown in FIG. 8, the aerodynamic air foil 65 is a wing-like structure, which is placed above the slip rings 28 and encompasses the entire upper subassembly housing 11*a*. The aerodynamic air foil 65 is preferably made of high density non-corrosive, hard plastic, such as PVC tubing to provide protection from the elements such as salt spray.

Figure 9:
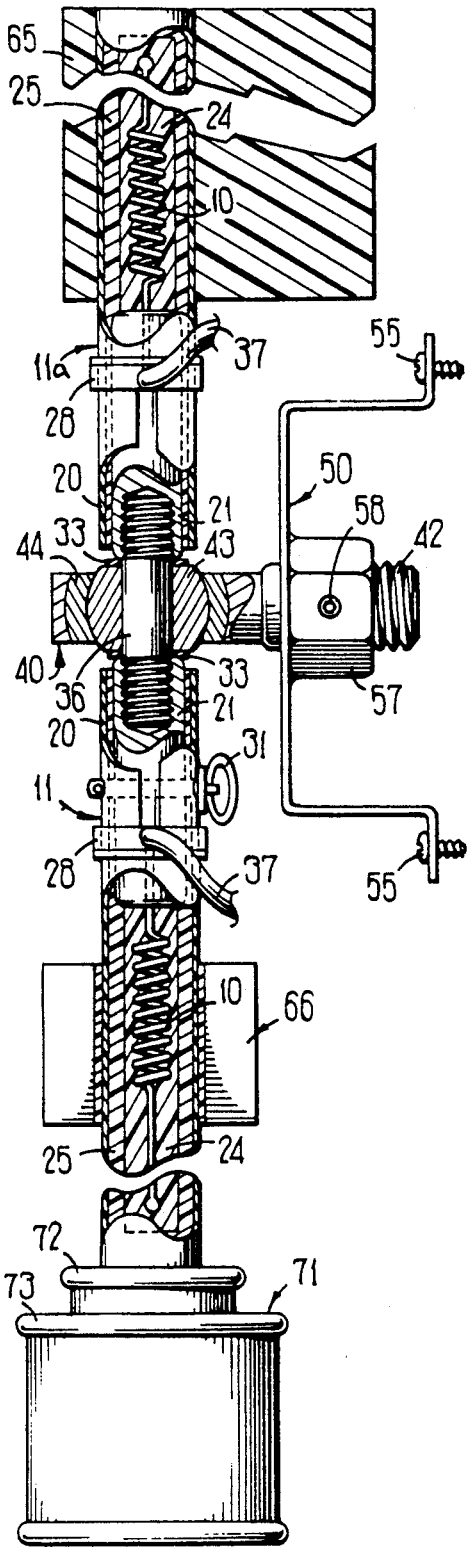
FIG. 9 is a cross-sectional view of the dual stabilized mount system with an aerodynamic air foil, an upper and a lower antenna, a lower fin, and a structural support fixture.
Figure 11:
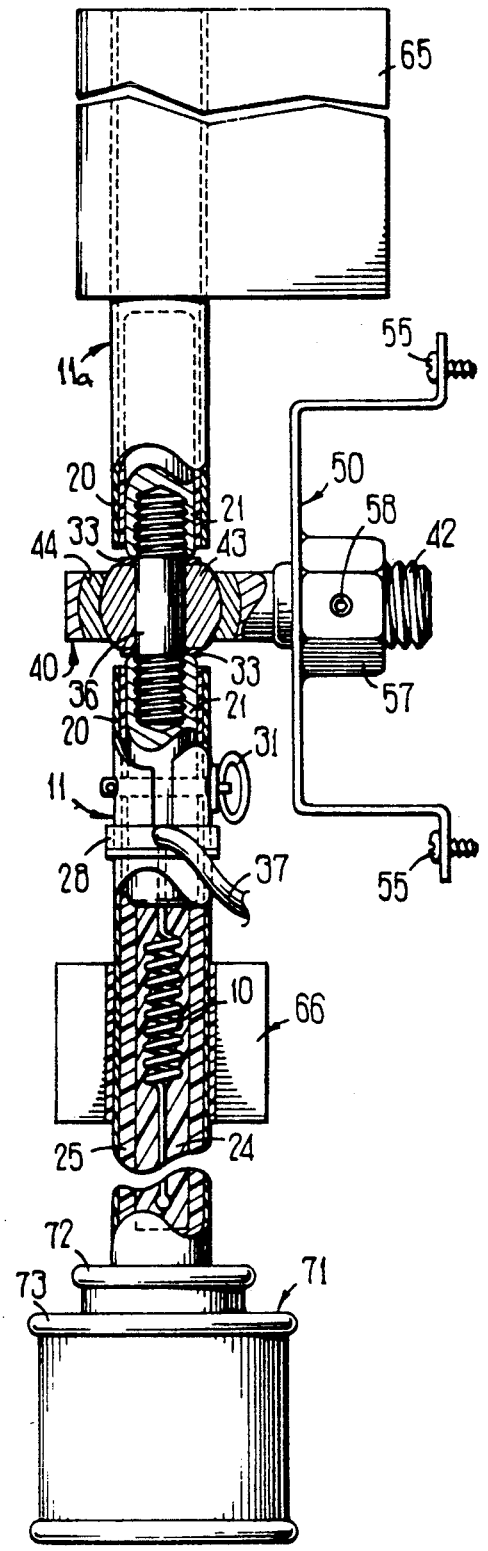
FIG. 11 is a cross-sectional view of the dual stabilized mount system with an aerodynamic air foil, a lower antenna, a lower fin, and a structural support fixture.

For this embodiment, as shown in FIG. 9, the surface area of the set of smaller fins 66 is approximately 25% less than the effective fin 64 for the preferred embodiment. As described above, the set of smaller fins 66 should be secured with epoxy or glue. Currently, the optimum positioning for them is approximately one-third the distance below the multi-axis bearing 40.

In other embodiments, the aerodynamic air foil 65 and smaller set of fins 66 may be used in conjunction with a single antenna 10. In these embodiments, the lower subassembly housing 11 may be assembled without an antenna 10 encapsulated within it (see FIG. 10), or the upper subassembly housing 11*a* may be assembled without an antenna 10 encapsulated within it (see FIG. 11).

Figure 13:
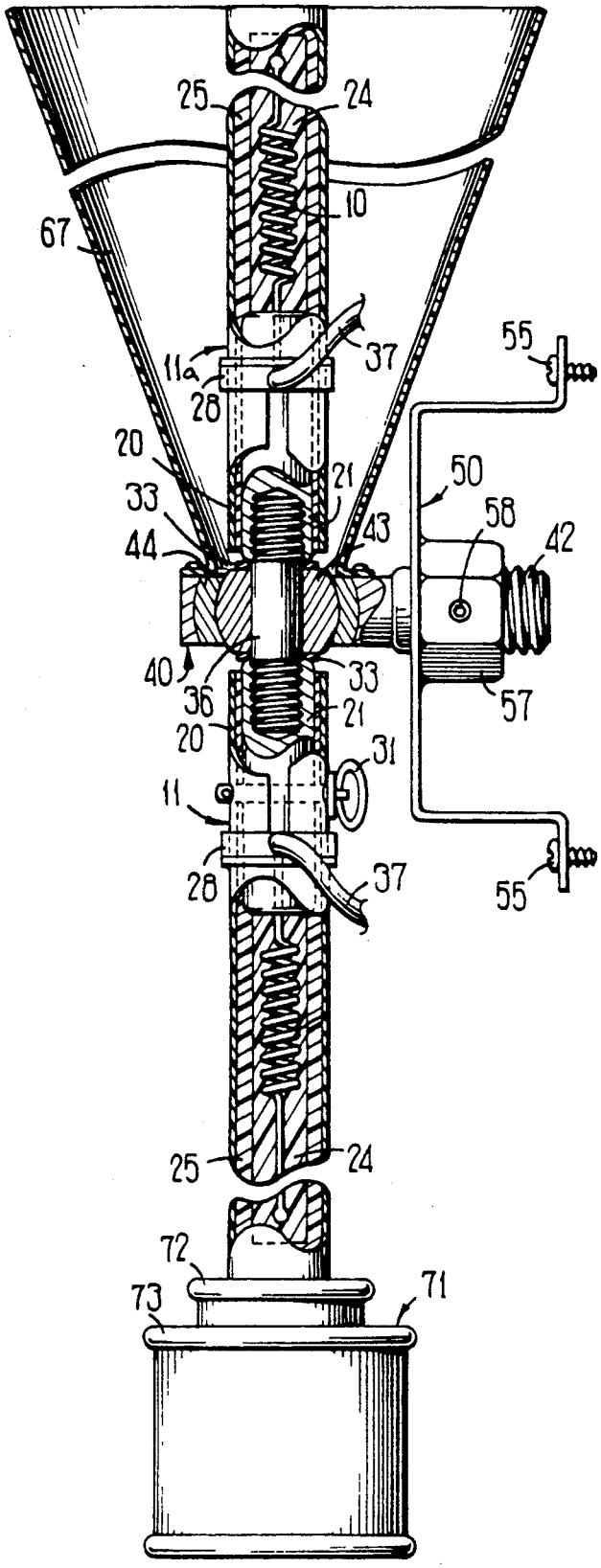
FIG. 13 is a cross-sectional view of the dual stabilized mount system with a protective shield, an upper and a lower antenna, and a structural support fixture.
Figure 12:
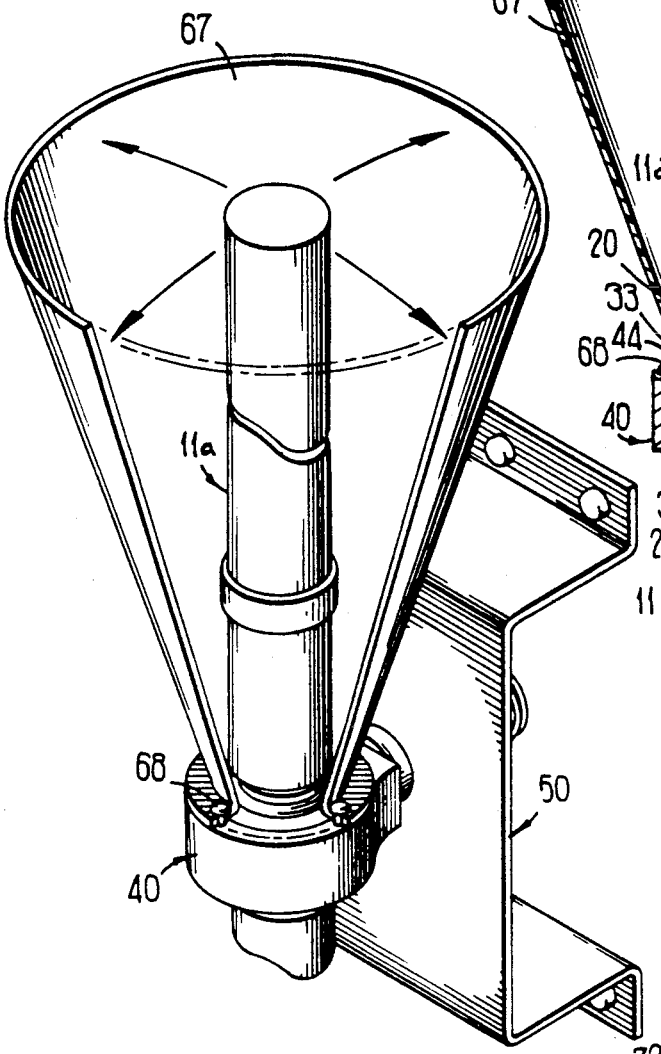
FIG. 12 is a three-dimensional exterior cut away view of the protective shield attached to the dual stabilized mount system.
Figure 14:
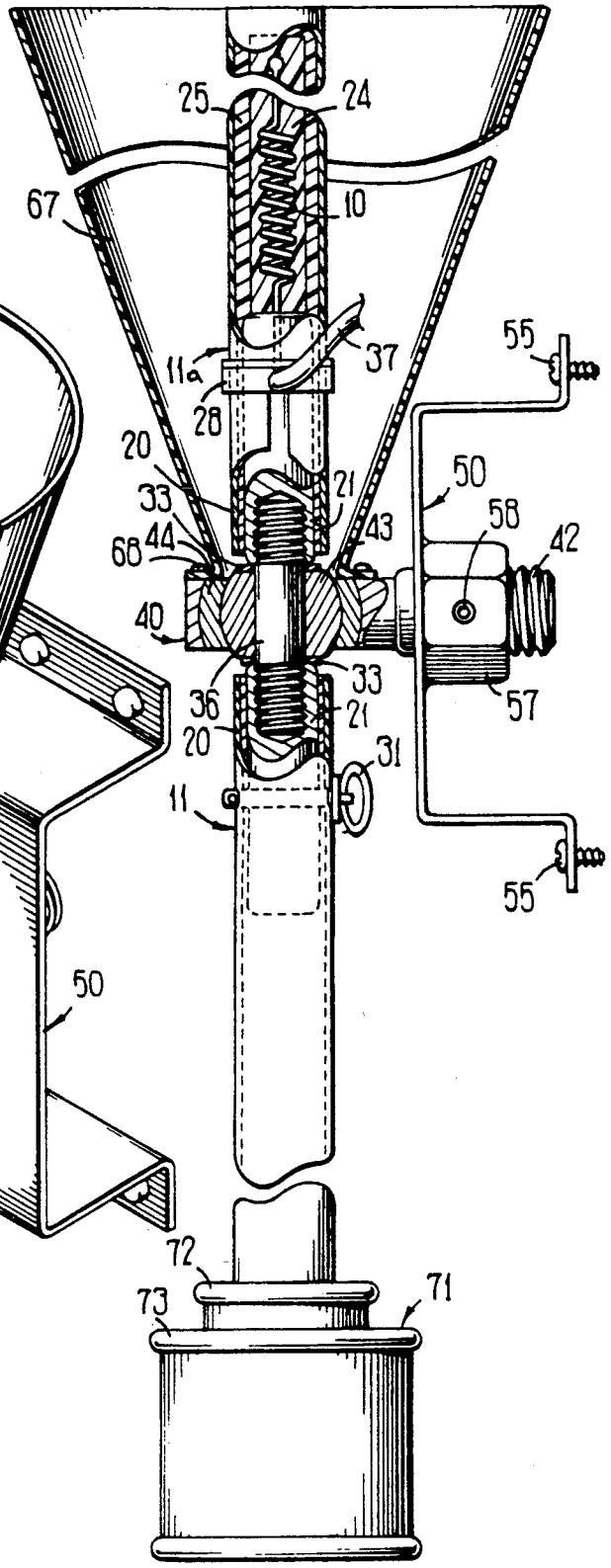
FIG. 14 is a cross-sectional view of the dual stabilized mount system with a protective shield, an upper antenna, and a structural support fixture.
Figure 15:
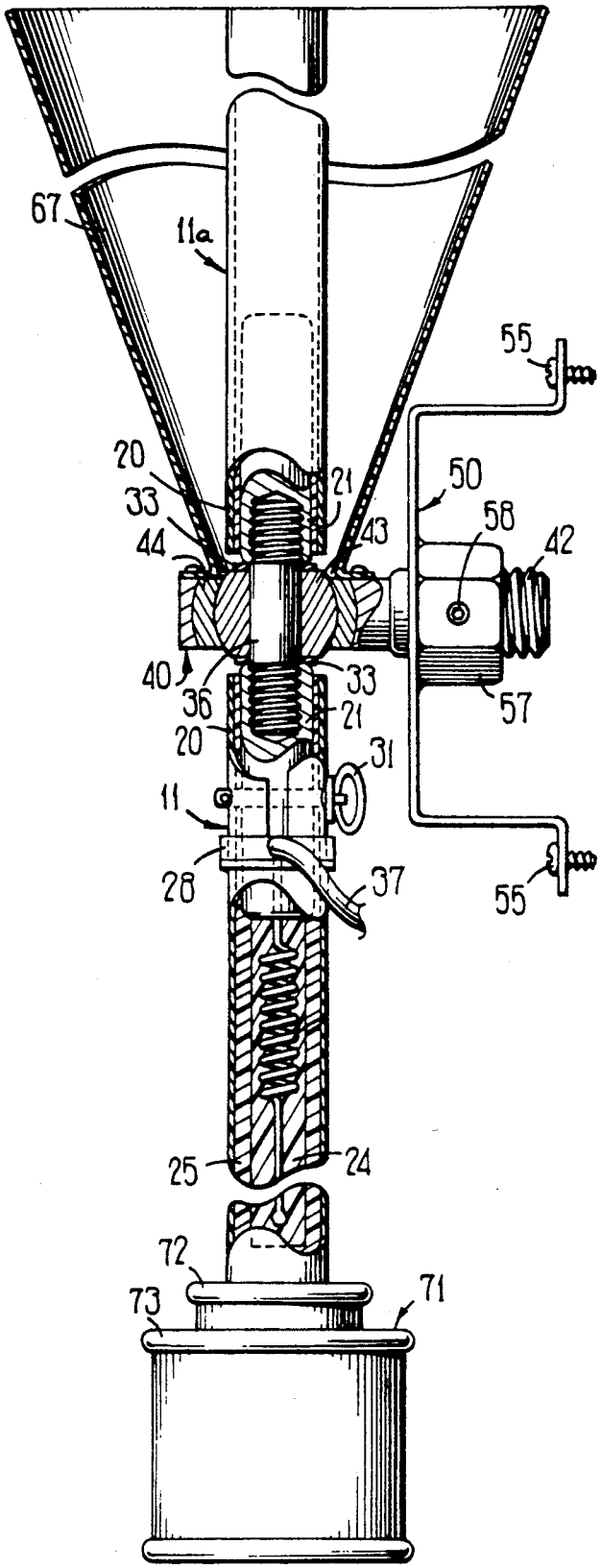
FIG. 15 is a cross-sectional view of the dual stabilized mount system with a protective shield, a lower antenna, and a structural support fixture.

In a further embodiment, as shown in FIGS. 12–15, the wind effect reducer may be a protective shield 67 which is conically shaped and is preferably made of fiberglass or high molecular weight ultraviolet stabilized plastic such as General Electric's LEXAN®. As shown in FIG. 12, the protective shield 67 is connected to the top surface 47 of the multi-axis bearing body 40 with several evenly spaced bolts 68, and extends to the top of the upper subassembly housing 11*a*. The protective shield 67 is constructed with an interior large enough to allow the upper subassembly housing 11*a* to pivot in any direction at an angle of up to 20° from its center point. The protective shield has several holes (not shown) to alleviate the pressure and to allow water drainage. As shown in FIG. 13, a set of fins for this embodiment is not necessary.

In other embodiments, the protective shield 67 may be used in conjunction with a single antenna 10. In these embodiments, the lower subassembly housing 11 may be assembled without an antenna 10 encapsulated within it (see FIG. 14), or the upper subassembly housing 11*a* may be assembled without an antenna 10 encapsulated within it (see FIG. 15).

Figure 7:
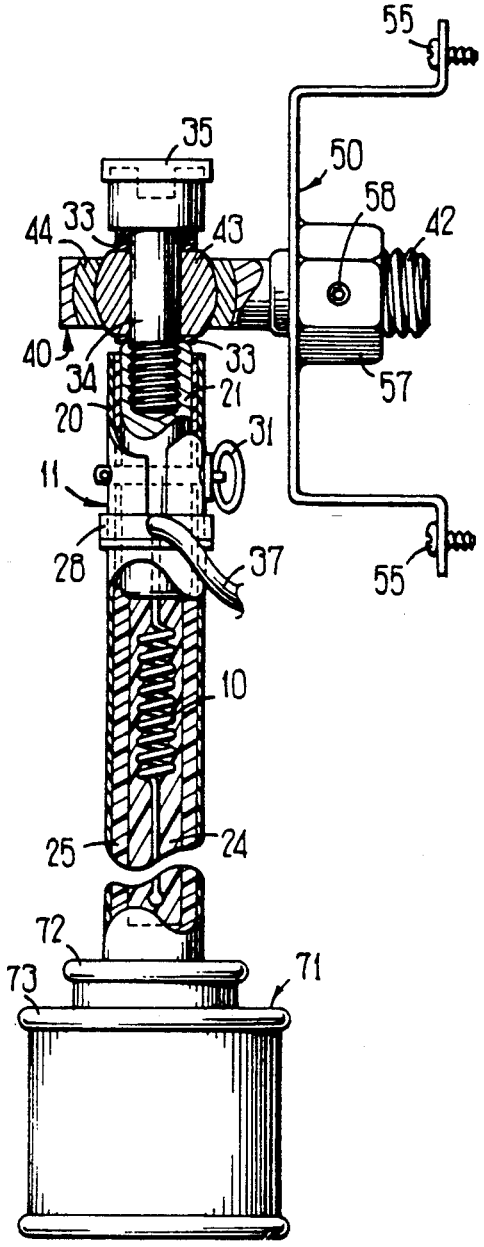
FIG. 7 is a cross-sectional view of the single stabilized mount system with a structural support fixture.

In a yet further embodiment, as shown in FIG. 7, a single stabilized mount system may be configured. This system is similar to the one described in the preferred embodiment but incorporates only the lower subassembly housing 11. As with the dual stabilized mount system, the single stabilized mount system is stabilized by the inertia mass 71 attached to the lower subassembly housing 11. Similarly, the weight of the inertia mass 71 remains approximately six times the weight of the entire stabilized mount system with the inertia mass 71 disconnected.

The lower subassembly housing 11 is connected to the multi-axis bearing 40 with an allen bolt 34, which has a hexagonal head. The allen bolt 34 rests on three nylon bushings 33, which rest on the top surface of the multi-axis bearing ball 43. The bottom surface of the multi-axis bearing ball 43 rests on one nylon bushing 33, which rests on top of the ferrule 21 of the lower subassembly housing 11. The allen bolt 34 is inserted through the ball 43, socket 44, and the lower bushing 33, and into the lower subassembly housing 11. The allen bolt 34 is secured to the lower subassembly housing 11 by screwing it into the interiorly threaded ferrule 21 in the subassembly housing 11. A plastic rain shield 35 may be snapped onto the head of the allen bolt 34 to protect it from the elements.

In another embodiment, as best shown in FIG. 16, a structural support platform 80 may be used to support the system. In the preferred embodiment, the structural support platform 80 has four horizontally slanted supports, also known as legs, 83. The legs 83 support the structural platform's top surface 81 and serve as the framing points for the bottom structure 82. Both the top surface 81 and the bottom structure 82 may be spot welded to the legs 83. The multi-axis bearing's flange (not shown), which contains the multi-axis bearing socket 44 and the multi-axis bearing ball 43, is secured into a center hole in the top surface 81 with bolts (not shown) or tack welds (not shown). The bottom structure 82 is also secured to a horizontal surface of a structure with evenly spaced bolts 84 or tack welds (not shown).

While several presently preferred embodiments of the present invention of a shipboard stabilized radio antenna mount system have been illustrated and described, persons skilled in the art will readily appreciate that various additional modifications and embodiments of the invention may be made without departing from the spirit of the invention as defined by the following claims.

We claim:

1. A stabilized mount system for a vehicle comprising:

an antenna assembly comprising an upper antenna subassembly and a lower antenna subassembly;

means located between said upper antenna subassembly and said lower antenna subassembly for connecting said antenna assembly to the vehicle, said connecting means allowing rotation of said antenna assembly about said connecting means;

means for stabilizing said antenna assembly including an inertia mass connected to said lower antenna subassembly; and means coupled to said antenna assembly for equalizing the effect of wind on each of said upper antenna subassembly and said lower antenna subassembly.

2. The system in accordance with claim 1, wherein said connecting means comprises a multi-axis bearing.

3. The system in accordance with claim 2, wherein said multi-axis bearing comprises:

a body having a socket formed therein; and a ball-like object partially enclosed in said socket and having a substantially flat top portion, a substantially flat bottom portion and a cylindrical hole through said ball-like object joining a center portion of said top portion and a center portion of said bottom portion.

4. The system in accordance with claim 1, wherein said inertia mass has a weight approximately six times the sum of the weight of the antenna assembly.

5. The system in accordance with claim 1, wherein said inertia mass is formed of a metallic material covered by a moisture-resistant material.

6. The system in accordance with claim 1, wherein said antenna assembly includes an exterior housing.

7. The system in accordance with claim 6, wherein said exterior housing is formed of a hard plastic material.

8. The system in accordance with claim 6, wherein said exterior housing has a cutout spline thereon for allowing passage therethrough for an antenna cable.

9. The system in accordance with claim 1, further comprising a means for attaching a cable from said antenna assembly to a telecommunication system, wherein said attaching means includes means for preventing the cable from winding about said antenna assembly.

10. The system in accordance with claim 9, wherein said preventing means includes a slip ring assembly connected to said antenna assembly and a plurality of slide contacts connected to the cable and positioned for sliding contact with the slip ring assembly.

11. The system in accordance with claim 1, wherein said wind effect equalizing means includes a fin assembly having at least one fin extending radially from said antenna assembly.

12. The system in accordance with claim 11, wherein said fin assembly has an effective projected surface area, $S_{PROJF}$, determined substantially by the equation:

$$S_{PROJF} = \frac{C_{DA} \times S_{PROJA} \times l_A}{C_{DF} \times l_F}$$

where:

$S_{PROJF}$ = The Effective Projected Surface Area of the Fin $C_{DA}$ = The drag of the Antenna Assembly $S_{PROJA}$ = The Effective Projected Surface Area of the Antenna Assembly $l_A$ = The length from the Connecting Means to the Antenna Assembly Center of Pressure $C_{DF}$ = The drag of the Fin $l_F$ = The length from the Connecting Means to the Center of Pressure of the Fin Area.

13. The system in accordance with claim 11, wherein said fin assembly is formed of a material from the group consisting of anodized aluminum and fiberglass.

14. The system in accordance with claim 11, wherein the center of pressure of said fin assembly is coupled to said lower antenna subassembly approximately one-third of the distance below said connecting means.

15. The system in accordance with claim 14, wherein said upper antenna subassembly is aerodynamically shaped.

16. The system in accordance with claim 15, wherein said fin assembly has an effective projected surface area, $S_{PROJF}$, determined substantially by the equation:

$$S_{PROJF} = .75 \times \left[ \frac{C_{DA} \times S_{PROJA} \times l_A}{C_{DF} \times l_F} \right]$$

where:

$S_{PROJF}$ = The Effective Projected Surface Area of the Fin $C_{DA}$ = The drag of the Antenna Assembly $S_{PROJA}$ = The Effective Projected Surface Area of the Antenna Assembly $l_A$ = The length from the Connecting Means to the Antenna Assembly Center of Pressure $C_{DF}$ = The drag of the Fin $l_F$ = The length from the Connecting Means to the Center of Pressure of the Fin Area.

17. The system in accordance with claim 11, wherein the center of pressure of said fin assembly is coupled to said lower antenna subassembly approximately one-third of the distance above said connecting means.

18. The system in accordance with claim 11, wherein said means for equalizing the effect of the wind comprises a protective shield.

19. The system in accordance with claim 18, wherein said protective shield is formed of a material from the group consisting of fiberglass and a high molecular weight ultraviolet stabilized plastic.

20. The system in accordance with claim 18, wherein said protective shield is conically shaped.

21. The system in accordance with claim 11, wherein said protective shield is constructed to allow said antenna assembly to rotate at an angle up to approximately twenty degrees.

22. The system in accordance with claim 11, wherein each said fin is a substantially planar surface.

23. The system in accordance with claim 11, wherein said fin assembly includes a plurality of fins.

24. An antenna angular rotation reducing system adapted for use with an antenna assembly, wherein the antenna assembly comprises an upper antenna subassembly and a lower antenna subassembly, said system comprising:

means located between said upper antenna subassembly and said lower antenna subassembly for allowing angular rotation of said antenna assembly about said angular rotation allowing means; and means for equalizing the effect of wind on each of said upper antenna subassembly and said lower antenna subassembly, wherein said means for equalizing the effect of wind is coupled to the antenna assembly.

25. The antenna angular rotation reducing system in accordance with claim 24, wherein said means for equalizing the effect of the wind comprises a fin.

26. The antenna angular rotation reducing system in accordance with claim 25, wherein said fin has an effective projected surface area, $S_{PROG_F}$, determined substantially by the equation:

$$S_{PROJF} = \frac{C_{DA} \times S_{PROJA} \times l_A}{C_{DF} \times l_F}$$

$S_{PROJF}$ = The Effective Projected Surface Area of the Fin $C_{DA}$ = The drag of the Antenna Assembly $S_{PROJA}$ = The Effective Projected Surface Area of the Antenna Assembly $l_A$ = The length from the Means for Allowing Angular Rotation to the Antenna Assembly Center of Pressure $C_{DF}$ = The drag of the Fin $l_F$ = The length from the Means for Allowing Angular Rotation to the Center of Pressure of the Fin Area.

27. The antenna rotation reducing system in accordance with claim 25, wherein said fin is formed of a material from the group consisting of anodized aluminum and fiberglass.

28. The antenna rotation reducing system in accordance with claim 25, wherein the center of pressure of said fin is connected approximately one-third of the distance below said means for allowing angular rotation on the antenna assembly.

29. The antenna rotation reducing system in accordance with claim 28, wherein for an upper portion of the antenna assembly being aerodynamically shaped, said fin has an effective projected surface area, $S_{PROJ_F}$, determined substantially by the equation:

$$S_{PROJF} = .75 \times \left[ \frac{C_{DA} \times S_{PROJA} \times l_A}{C_{DF} \times l_F} \right]$$

where:

$S_{PROJF}$ = The Effective Projected Surface Area of the Fin $C_{DA}$ = The drag of the Antenna Assembly $S_{PROJA}$ = The Effective Projected Surface Area of the Antenna Assembly $l_A$ = The length from the Means for Allowing Angular Rotation to the Antenna Assembly Center of Pressure $C_{DF}$ = The drag of the Fin $l_F$ = The length from the Means for Allowing Angular Rotation to the Center of Pressure of the Fin Area.

30. The antenna rotation reducing system in accordance with claim 25, wherein the center of pressure of said fin is connected approximately one-third of the distance above said means for allowing angular rotation on the antenna assembly.

31. The angular rotation reducing system in accordance with claim 24, wherein said means for equalizing the effect of the wind comprises a protective shield.

32. The angular rotation reducing system in accordance with claim 31, wherein said protective shield is formed of a material from the group consisting of fiberglass and a high molecular weight ultraviolet stabilized plastic.

33. The angular rotation reducing system in accordance with claim 31, wherein said protective shield is conically shaped.

34. The angular rotation reducing system in accordance with claim 31, wherein said protective shield is constructed to allow said antenna assembly to rotate at an angle of up to approximately twenty degrees.

* * * * *